US010711411B2

(12) United States Patent
Morefield

(10) Patent No.: US 10,711,411 B2
(45) Date of Patent: Jul. 14, 2020

(54) ELECTRO-ACTIVE VITREOUS ENAMEL COATED DOWEL BAR

(71) Applicant: United States of America as Represented by The Secretary of The Army, Alexandria, VA (US)

(72) Inventor: Sean W. Morefield, Champaign, IL (US)

(73) Assignee: UNITED STATES OF AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 0 days.

(21) Appl. No.: 15/941,788

(22) Filed: Mar. 30, 2018

(65) Prior Publication Data

US 2019/0301106 A1 Oct. 3, 2019

(51) Int. Cl.
*E01C 11/14* (2006.01)
*E04B 1/48* (2006.01)

(52) U.S. Cl.
CPC ..... *E01C 11/14* (2013.01); *E04B 1/483* (2013.01)

(58) Field of Classification Search
CPC ..... E01C 11/14; E01C 11/08; E01C 11/12; E04B 1/48; E04B 1/483; F16B 5/00; F16B 5/0024; F16B 2013/009; F16B 13/12; F16B 13/00
See application file for complete search history.

(56) References Cited

U.S. PATENT DOCUMENTS 1,279,431 A * 9/1918 Poulston ..... E01C 11/14 404/63
2,074,935 A * 3/1937 Potthoff ..... B05B 13/0609 118/58
2,278,917 A * 4/1942 Curry ..... E01C 11/14 404/136
2,305,979 A * 12/1942 Mitchell ..... E01C 11/14 404/59
2,575,247 A * 11/1951 Carter ..... E01C 11/14 404/60
2,627,793 A * 2/1953 White ..... E01C 11/14 404/62
2,858,748 A * 11/1958 Crone ..... E01C 11/14 404/59
3,238,856 A * 3/1966 Jahn ..... E01C 11/14 404/51
4,752,153 A * 6/1988 Miller ..... E01C 11/14 404/49

(Continued)

*Primary Examiner* — Abigail A Risic
(74) *Attorney, Agent, or Firm* — Brian C. Jones

(57) ABSTRACT

An enamel coated steel dowel bar and a method of manufacturing said enamel coated steel dowel bar for use in joining together and stabilizing concrete slabs by drilling a first hole at a first end of an axis of the dowel bar, drilling a second hole at a second end of the axis of the dowel bar, configuring a first end plug into the first hole of the dowel bar, configuring a second end plug into the second hole of the dowel bar, attaching a first end cap over the first end plug and the first hole, and attaching a second end cap over the second end plug and the second hole, wherein a pin is removably attached to the first hole and the second hole to mount the dowel bar during an enamel coating process and wherein the dowel bar is slidably attached to the first end cap and the second end cap.

13 Claims, 5 Drawing Sheets

(56) References Cited

U.S. PATENT DOCUMENTS

| | | | | |
|---|---|---|---|---|
| 5,176,481 | A * | 1/1993 | Schiefer | F16B 13/065 411/55 |
| 6,692,184 | B1 * | 2/2004 | Kelly | E01C 7/147 404/52 |
| 2001/0022918 | A1 * | 9/2001 | Hu | E01C 11/14 403/294 |
| 2005/0265802 | A1 * | 12/2005 | Miller | E01C 11/14 411/351 |
| 2007/0134063 | A1 * | 6/2007 | Shaw | E01C 11/14 404/62 |
| 2016/0017548 | A1 * | 1/2016 | Schenk | E01C 11/14 404/62 |
| 2016/0017549 | A1 * | 1/2016 | Schenk | E01C 11/14 404/47 |
| 2018/0080181 | A1 * | 3/2018 | Hershberger | B29C 69/001 |
| 2019/0024367 | A1 * | 1/2019 | Shaw | E04G 21/185 |

* cited by examiner

ELECTRO-ACTIVE VITREOUS ENAMEL COATED DOWEL BAR

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

TECHNICAL FIELD

The embodiments herein generally relate to the construction, manufacture, and use of enamel coated steel dowel bar assemblies for use in joining together and stabilizing concrete slabs and other concrete segments. More specifically, the embodiments herein generally relate to the construction, manufacture, and use of electro-active vitreous enamel coated steel dowel bars.

BACKGROUND

Steel dowel bars have generally been used to join together and restrict concrete slabs and concrete segments in the construction and formation of concrete highways, airport runways, and other concrete structures. During the construction of concrete highways, concrete slabs are formed in sections, and adjacent concrete sections are kept in place in relation to one another using steel restraining dowel bars. These dowels bars are generally made in the form of elongated, cylindrical, high-shear rods, and they are typically made of high strength steel.

For example, in the construction of concrete roadways, multiple concrete dowel bars may be embedded between adjacent concrete slabs and may be spaced intermittently within the slabs at lateral intervals as joints between adjoining concrete slabs. These dowel bars are typically designed to permit horizontal displacement between adjacent segments of the concrete slabs, to allow movement between concrete slabs caused by thermal contraction and extraction. These dowel bars need to be as slippery as possible so that when they are placed within the concrete surrounding the dowel bars, they allow the concrete slabs to move horizontally in relation to each other. If the dowel bars do not easily slide or slip within the concrete cavity in which they reside, contractive and expansive forces caused by thermal heating and cooling will cause the concrete slabs to crack, break, and spall. Damage locally even at one steel dowel bar can cause significant damage to adjacent and nearby concrete slabs, requiring expensive and extensive repairs.

These dowel bars also keep the concrete slabs in relative uniformity against one another and restrict unwanted movement. The dowel bars prevent vertical displacement, twisting and turning, movement to the left or to the right, and rotation, between the concrete slabs, which can cause unevenness or cracking in the pavement surface. Such dowel bars, therefore, assist in maintaining a smooth top surface of the pavement, while simultaneously increasing, the strength of the concrete in the region of the joint.

Additionally, in areas where salt may be applied to a concrete roadway to reduce icing conditions, or in areas where salt may be present in sprays and mists from oceans, the concrete segments that are nearby the mist and sprays may fail, as the salt may increase and accelerate the corrosion of the steel dowel bars. Corroding steel bars, and the rust that builds up on the steel dowel bars, prevents the dowel bars from sliding back and forth within the concrete cavities that surround the dowel bars. Rusting causes steel bars to corrode and expand, resulting in up to six time its original volume. As the steel bars expand due to corrosion, friction within the concrete cavities is increased, thereby failing to allow the concrete slabs to slip and move horizontally in relation to each other. Where salt is applied to the surface of a concrete roadway to reduce the buildup of ice, or may be present in salt spray or mist from oceans, the concrete segments tend to fail quicker over time, as the salt increases corrosion of the steel dowel bars that align the segments.

Additionally, during the manufacturing of the dowel bar, enamel coating may be applied to the dowel bar in a baking process. The enamel coating is typically applied by spraying (or by other surface-application methods) an epoxy coating over the dowel bar. During the application of the enamel coating, the steel dowel bar is held along its exterior cylindrical surface. In the area where the dowel bar is held, the enamel coating will be absent, thus affecting the continuity of the application of the coating. These discontinuity areas may expose the steel dowel bar to small imperfections, scratches, chips, cracks and other flaws, and thereby degrade its integrity and resistance to corrosion and rusting. There is a need in the art for an improved process of manufacture that prevents or decreases failures caused by such manufacturing detects.

In view of the foregoing, an embodiment herein provides a method of manufacturing dowel bars that includes creating holes at disparate ends of the dowel bar to enable the insertion of pins to support and hold in place the dowel bar during the enamel coating process. An embodiment herein also provides a system comprising a dowel bar having holes at the ends of the axis of the dowel bar, end plugs inserted into such manufacturing holes, and caps attached over ends of the dowel bars.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended, merely to facilitate an understanding of ways in which the embodiments herein may be practiced and to further enable those of skill in the art to practice the embodiments herein. Accordingly, the examples should not be construed as limiting the scope of the embodiments herein.

Figure 1C:
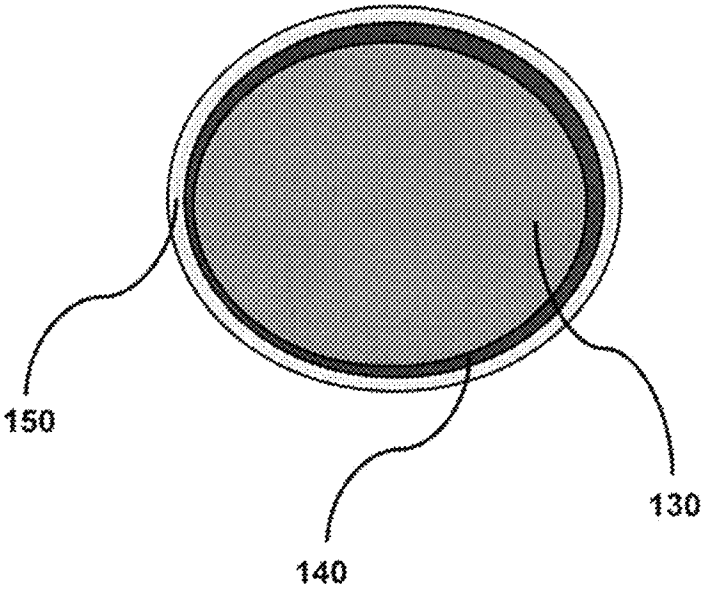
FIG. 1C is an illustration of a concrete dowel bar according to an embodiment.
Figure 1B:
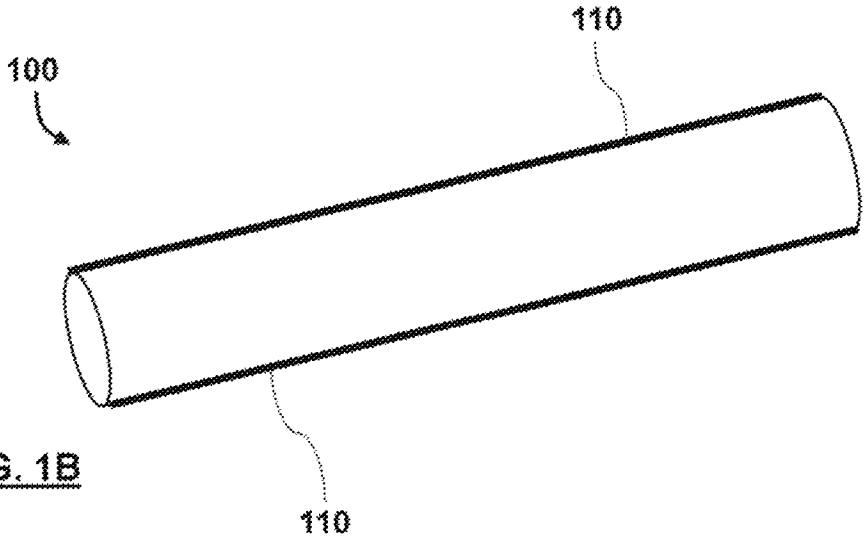
FIGS. 1A and 1B are illustrations of a dowel bar according to an embodiment herein.
Figure 1A:
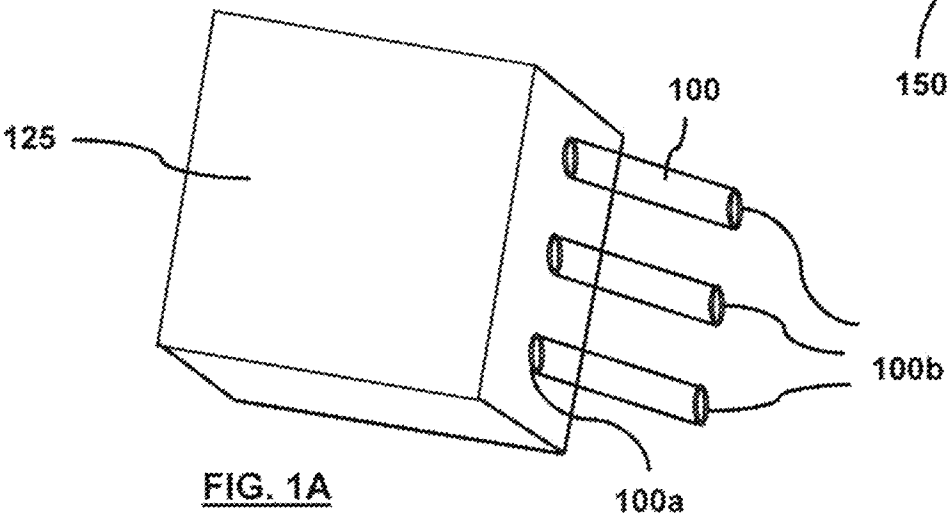

Now referring to the drawings, FIG. 1A illustrates dowel bars 100 embedded in a concrete slab 125 according to an exemplary embodiment. The dowel bars 100 are typically spaced apart at one-foot intervals as shear-bridging, slab-to-slab load-transfer components at each separation joint that exists between adjacent concrete slabs. A first end 100*a* of the dowel bar 100 is embedded in a first slab 125 and a second end 100*b* of the dowel bar 100 is embedded in an adjacent concrete slab not shown). The adjacent concrete slabs 125 may lie side-by-side (or end-to-end) along a highway, and the dowel bars 100 interconnect the slabs 125. The dowel bars 100 are intended to connect the slabs 125 together and prevent shifting and separation of one slab 125 from the other. The plurality of connecting dowel bars 100 are axially aligned with a corresponding plurality of mating channels that are disposed along an opposing end of an adjacent concrete slab 125. Each of the plurality of connecting dowel bars 100 is slidable through, and outwardly from, respective ones of plurality of slots formed in a first slab 125 for receipt by an axially-aligned mating channel formed in the adjacent slab 125. To allow the slabs 125 to move independently, the dowel bars 100 are coated with a bond breaker or epoxy coating before being embedded in the concrete slab 125 so that when the concrete hardens, the dowel bars 100 will allow the slabs 125 to slide longitudinally during thermal contraction and expansion.

FIGS. 1B and 1C schematically illustrate the construction of a dowel bar 100 according to an exemplary embodiment. The dowel bar 100 may include a jacket or a protective coating 110 to protect the steel core of the dowel bar 100 from corrosive elements. The protective coating 110 may cover the entirety of the dowel bar 100.

Specifically, as illustrated in FIG. 1C, the dowel bar 100 may include a steel core 130, a silicon steel transition layer 140, and a glassy vitreous enamel coating 150. The silicon steel transition layer 140 may be fired to create an adhesive layer to the steel core 130. The glassy vitreous enamel coating 150 may then be applied over the fired ground coat silicon steel transition layer 140. White or colored second coats of enamel may be applied over the fired silicon steel transition layer 140. For electrostatic enamels, the colored enamel powder may be applied directly over a thin untired ground silicon steel transition layer 140 that may be co-fired with the glassy vitreous enamel coating 150 in a very efficient two-coat/one-fire process.

Frit in the ground coat silicon steel transition layer 140 may contain smelted-in cobalt and/or nickel oxide as well as other transition metal oxides to catalyze the enamel-steel bonding reactions. During firing of the glassy vitreous enamel coating 150 at temperatures between 760° C. to 805° C. (1400° F. and 1640° F.), iron oxide scale may form on the steel. The molten enamel may dissolve the iron oxide and precipitate the cobalt and nickel. The iron may act as an anode in an electro-galvanic reaction in which the iron is again oxidized, dissolved by the glass, and oxidized again with the available cobalt and nickel limiting the reaction. Finally, the surface of die dowel 100 may become roughened with the glass anchored into the holes.

The glassy vitreous enamel coating 150 may be highly chemically resistant, especially when formulated with an alkali resistant compound frit including zirconia and lithium. This may prevent alkali attack on the dowel bar 100 that may eventually erode the glassy vitreous enamel coating 150. This glassy vitreous enamel coating 150 may resist the penetration of other chemicals that would attack and corrode the underlying steel core 130. The silicon steel transition layer 140 may act as a secondary layer of protection for the dowel bar 100 if cracks or chips occur on the surface of the dowel bar 100 during the manufacturing process. Silicon may significantly increase the electrical resistivity of the steel core 130, and helps with the reduction of corrosion.

As discussed above, in the typical process of enamel coating the dowel bar, the dowel bar is held at points along its longitudinal surface while it is baked at almost 1000° C. The holding of the dowel bar at the connection points may create flaws in the specific areas, which may require that the dowel bar undergo a second expensive baking process.

Figure 2:
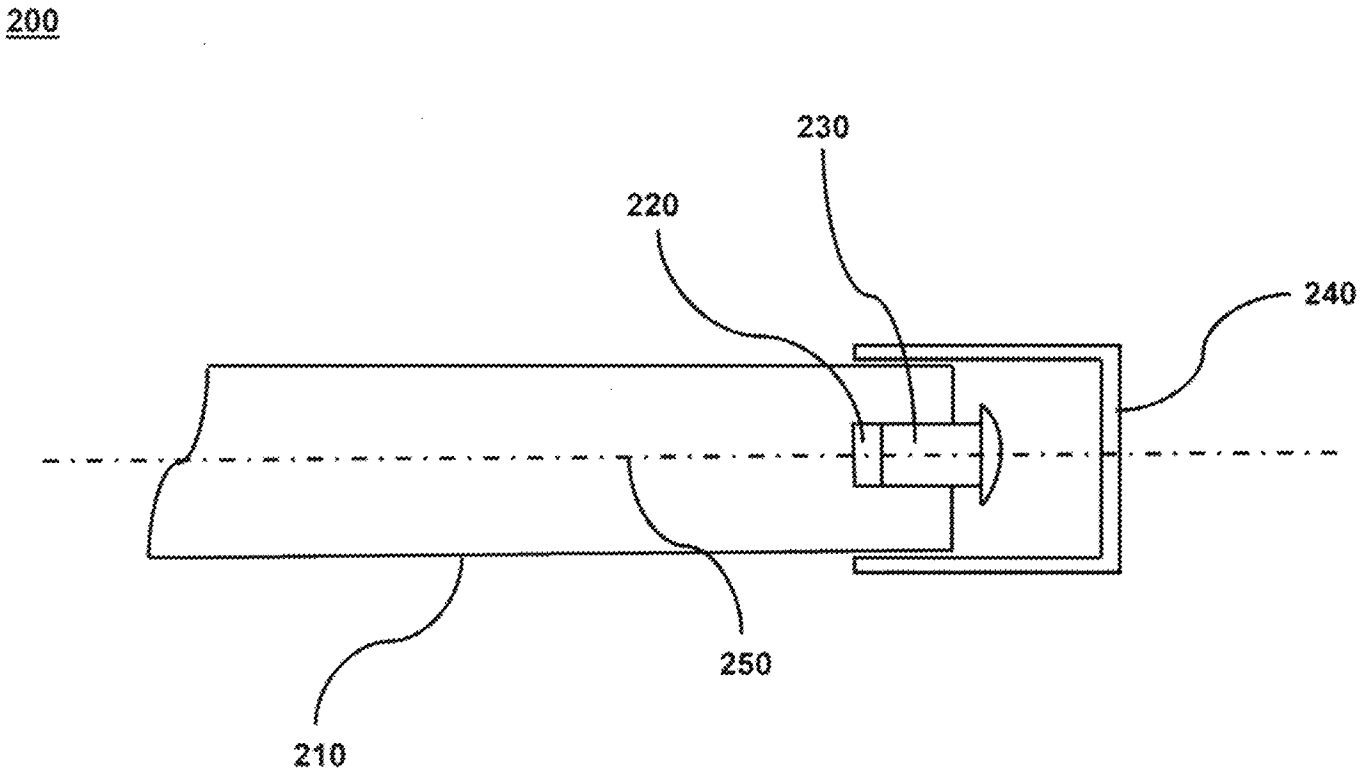
FIG. 2 illustrates an end cap according to an embodiment.

Turning now to FIG. 2, a schematic illustration of the dowel bar assembly 200 according to an exemplary embodiment is provided. The dowel bar assembly 200 includes a dowel bar 210, a slot 220, an end plug 230, and an end cap 240. According to the exemplary embodiment, the holding points for the dowel bar 210 may be positioned at an axis 250 of the dowel bar 210. During the enamel coating process of the dowel bar 210, the dowel bar 210 may be held by a pin that is inserted into the slot 220.

Specifically, the slot 220 may be drilled at one or both ends of the dowel bar 210 at approximately the area of the axis 250. By drilling the slot 220 at one or both ends of the dowel bar 210, the dowel bar 210 may be mounted on a pin (not shown) during the enamel coating backing process of the dowel bar 210, with no decrease in mechanical strength of the dowel bar 210 over time even if the slot 220 corrodes. The slot 220 may be coated with a protective coating or may be used for connection to the interior of the steel dowel bar 210 electrically for a cathodic protection system.

Cathodic protection processing may be used to control the corrosiveness of a metal surface by making it the cathode of an electrochemical cell. The metal to be protected, in this case, the dowel bar 210, may be connected with another more easily corrodible metal, in this case, the end plug 230, and the end plug 230 may act as the anode of the electrochemical cell.

The end plug 230 may also be provided as a galvanic or sacrificial anode, and may have a more "active" voltage (more negative electrochemical potential) than the metal of the steel dowel bar 210 to which it is attached. For effective cathodic processing, the potential of the steel dowel bar 210 may be negatively polarized until the surface of the dowel bar 210 has a uniform potential. At that stage, the driving force for the corrosive reaction is removed. The galvanic anode continues to corrode, consuming the anode material until eventually it must be replaced. The polarization is caused by die electron flow from the anode to the cathode.

The driving force for the cathodic processing current is the difference in electrochemical potential between the anode and the cathode.

Returning to FIG. 2, the end cap 240 may provide protection to the end plug 230, and the steel dowel bar 210 may be attached to the end cap 240 in a manner in which it slides within the cavity of the end cap 240.

Figure 3:
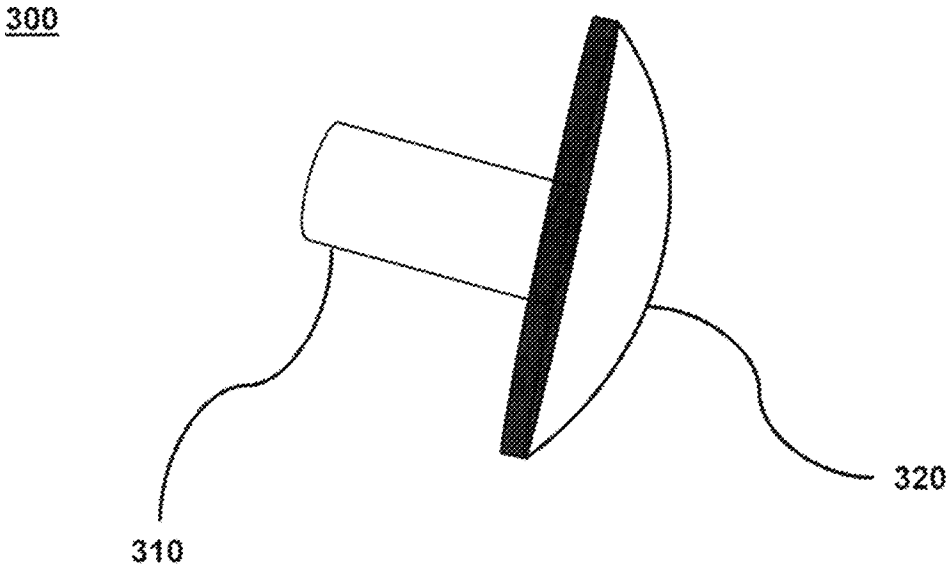
FIG. 3 illustrates a schematic example of a dowel bar assembly according to an embodiment.

Turning now to FIG. 3, a schematic illustration of the end plug 300 is provided. The end plug 300 includes a filler portion 310 that is tilted into the slot 220 (FIG. 2) and a head portion 320. The head portion 320 may have a mushroom shape, but is not limited thereto. The end plug 300 may be composed of a zinc aluminum alloy. The end plug 300 may be applied to plug the slot 220 (FIG. 2) at the end(s) of the steel dower bar 210 (FIG. 2). According to an exemplary embodiment, the outer surface of the head portion 320 of the end plug 300 may not be coated with the same material that the dowel bar 210 (FIG. 3) is coated with.

The end plug 300 covers the slot 220 (FIG. 2), thus reducing corrosion in the slot 200 (FIG. 2) and protecting the steel from corrosion, and also electrically connects the dowel steel bar 210 (FIG. 2) to additional sacrificial anode material. These end caps are connected electrically to the plugs, which then provide a complete cathodic protection system.

Figure 4:
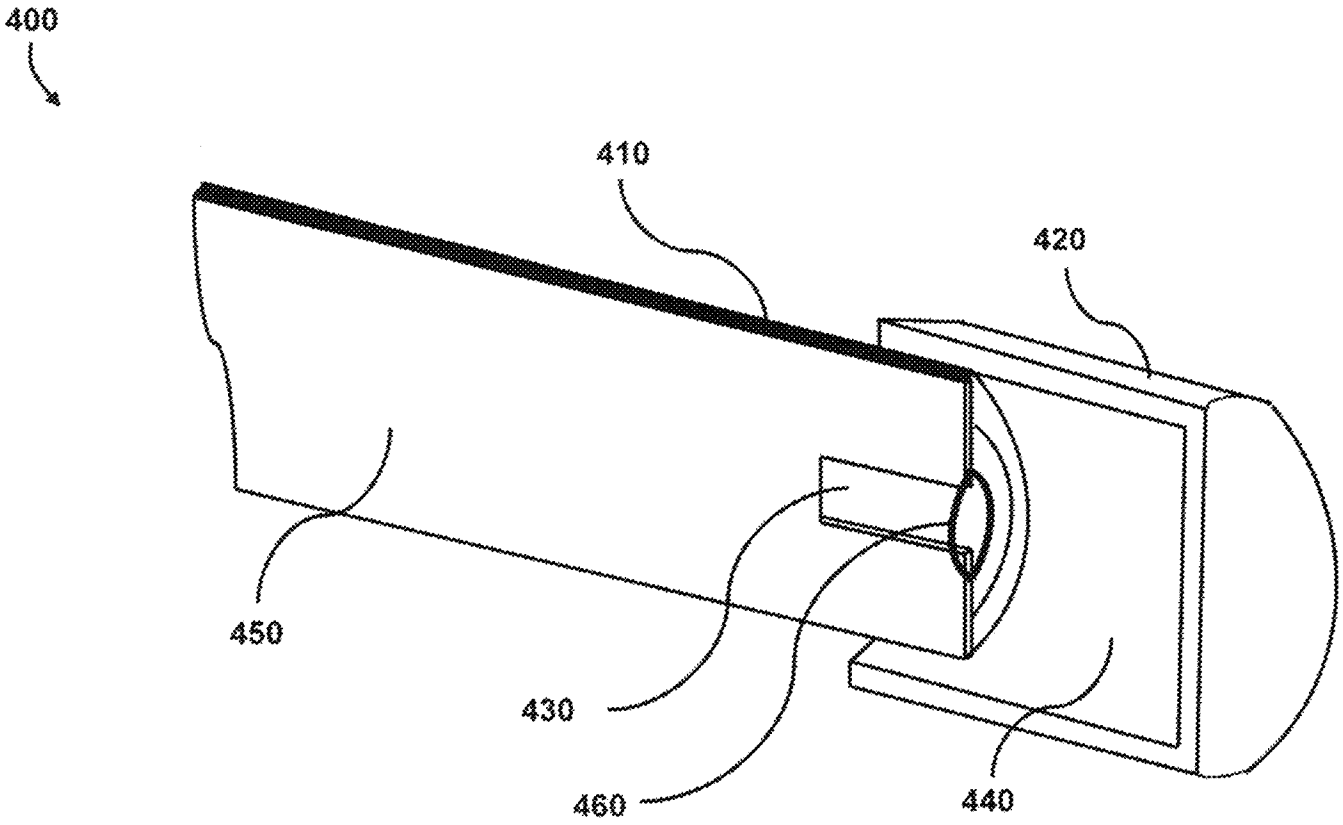
FIG. 4 illustrates another example of a dowel bar assembly according to an embodiment.

FIG. 4 schematically illustrates an example of a dowel bar assembly 400 according to an embodiment. The dowel bar assembly 400 includes a steel dowel bar 450, a slot 430 into which an end plug 460 is inserted, an end cap 420, which envelopes the end of the dowel bar 450 and also envelopes the end cap 420. The steel dowel bar 450 is operable to slide within a cavity 440 of the end cap 420. The dowel bar 450 may be protected from corrosive elements by a vitreous enamel coating 410. The depth of the slot 430 may vary, and may be dependent on the type and style of pin that is used to hold the dowel bar 450 during the enamel coating process. It is noted that the applied width and depth of the slot 430 does not affect the strength and integrity of the dowel bar 450.

Figure 5:
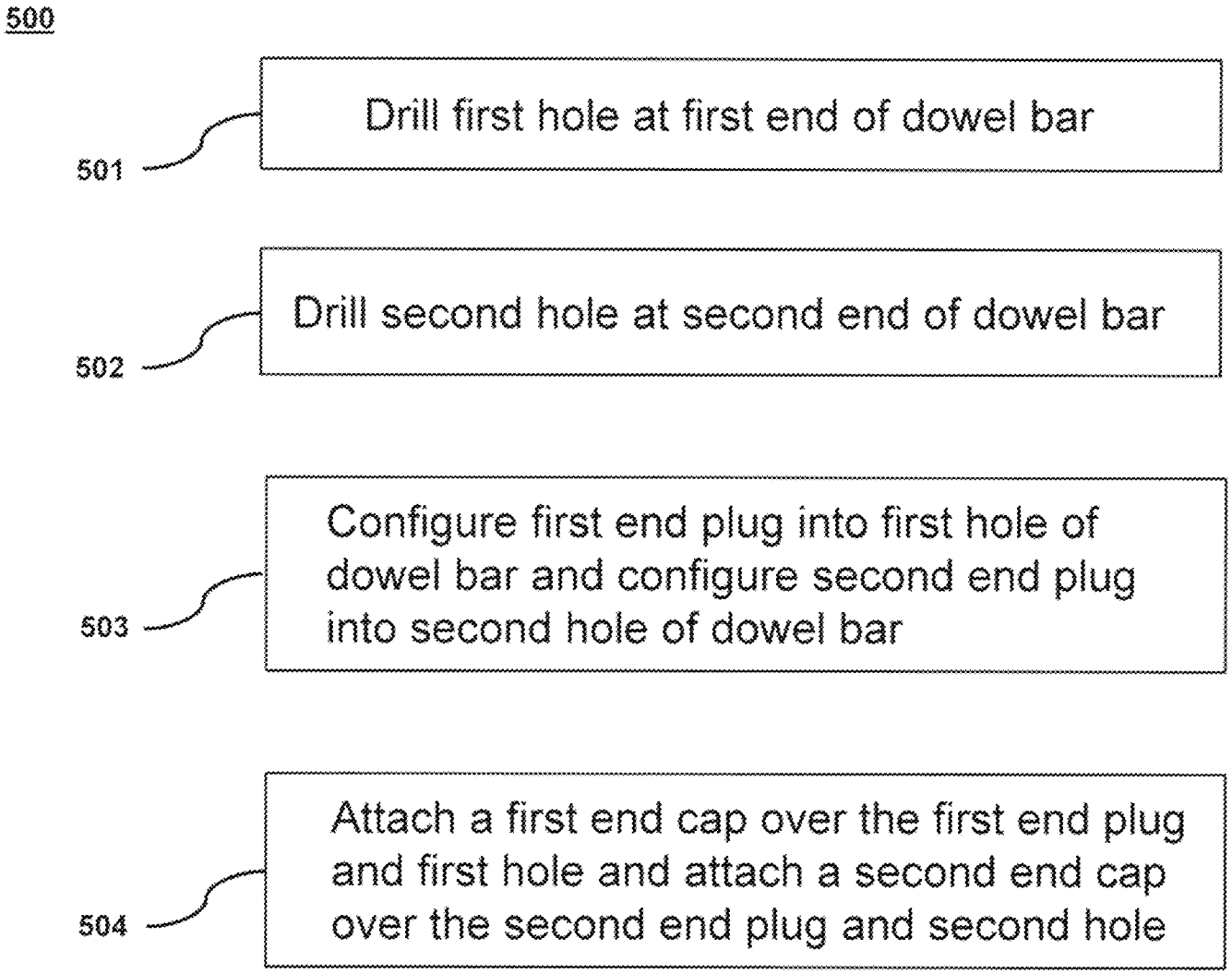
FIG. 5 is a flow chart of a method of manufacturing a dowel bar according to an embodiment.

FIG. 5 is a flow chart illustrating a method 500 for manufacturing a dowel bar according to an exemplary embodiment. In illustrated processing block 501, a first slot or hole may be drilled into a first end of the dowel bar at a predetermined depth, and at processing block 502, a second hole or slot may be drilled into a second end of the dowel bar at a predetermined depth. The first and second holes may be covered with a protective coating in order to reduce corrosive effects on the dowel bar. The width and the depth of the slots or holes does not affect the integrity and strength of the dowel bar.

In illustrated processing block 503, a first end plug may be configured into the first hole of the dowel bar and a second end plug may be configured into the second hole of the dowel bar. The first and second end plugs may have a mushroom shape, and may be comprised of a zinc aluminum alloy. However, the shape and composition of the first and second end plugs, are not limited thereto, and end plugs of different shapes and composition may be applied.

In illustrated processing block 504, a first end cup may be attached over the first end plug and the first hole, and a second end cap may be attached over the second end plug and the second hole. The dowel bar may be slidably installed in the first end cap and the second end cap.

Although the embodiments discussed above are related to the insertion of dowel bars in concrete slabs used in the construction of roadways, this is only exemplary. The embodiments may also be applied to the construction of bridges and road overpasses.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A method of manufacturing a solid dowel bar having a protective coating covering the entirety of the dowel bar, the method comprising:

drilling a first bole at a first end of an axis of the solid dowel bar;

drilling a second hole at a second end of the axis of the solid dowel bar;

holding said solid dowel bar with at least one pin inserted into said first hole or said second hole, and applying a protective coating covering the entirety of the dowel bar.

2. The method of claim 1, further comprising configuring a first end plug into the first hole of the solid dowel bar, and configuring a second end plug into the second hole of the solid dowel bar; and wherein the first end plug and the second end plug are composed of a zinc aluminum alloy.

3. The method of claim 1, further comprising attaching a first end cap over the first end plug and the first hole and attaching a second end cap over the second end plug and the second hole, wherein the solid dowel bar slidably attached to the first end cap and the second end cap, and wherein the dowel bar moves in a longitudinal direction within the first end cap and the second end cap.

4. The method of claim 1 wherein said protective coating comprises a silicon transition layer 140 fired to create an adhesive layer, and a glassy vitreous enamel coating 150 applied over said silicon transition layer.

5. The method of claim 1 wherein said protective coating is formed from an applied silicon transition layer 140 and a glassy vitreous enamel coating 150 applied over said silicon transition layer, and wherein both layers are fired together in a two-coat/one-fire step.

6. A solid dowel device having a protective coating covering the entirety of the dowel bar comprising:

a solid dowel bar having a first hole at a first end of an axis of the dowel bar, and a second hole at a second end of the axis of the dowel bar;

a protective coating covering the entirety of the dowel bar made in one step by holding said solid dowel bar with at least one pin inserted into said first hole or said second hole and coating the dowel bar, a first end plug attached to the first hole;

a second end plug attached to the second link;

a first end cap attached over the first end plug and the first hole; and a second end cap attached over the second end plug and the second hole, wherein the coated, solid dowel bar is slidably attached to the first end cap and the second end cap.

7. The device of claim 6, wherein the first hole and the second hole are covered with, an alkali-resistant protective coating.

8. The device of claim 6, wherein the first end plug and the second end plug are electrical connectors to a cathodic protection system.

9. The device of claim 6, wherein the first end plug and the second end plug have a mushroom shape.

10. The device of claim 6, wherein the first end plug and the second end plug are composed of a zinc aluminum alloy.

11. The device of claim 6, wherein the dowel bar moves in a longitudinal direction within the first end cap and the second end cap.

12. The device of claim 6 wherein said protective coating comprises a silicon transition layer 140 tired to create an adhesive layer, and a glassy vitreous enamel coating 150 applied over said silicon transition layer.

13. The device of claim 6 wherein said protective coating is formed from an applied silicon transition layer 140 and a glassy vitreous enamel coating 150 applied over said silicon transition layer, and wherein both layers are fired together in a two-coat/one-fire step.

* * * * *